US010806665B2

(12) United States Patent
Murto et al.

(10) Patent No.: US 10,806,665 B2
(45) Date of Patent: Oct. 20, 2020

(54) SYSTEM AND METHOD FOR FREEZE-DRYING AND PACKAGING

(71) Applicant: Teleflex Life Sciences Limited, Valletta (MT)

(72) Inventors: James A. Murto, Maple Grove, MN (US); Stephen A. Penegor, Watertown, MN (US)

(73) Assignee: Teleflex Life Sciences Limited, Valletta (MT)

( * ) Notice: Subject to any disclaimer, the term of this patent is extended or adjusted under 35 U.S.C. 154(b) by 397 days.

(21) Appl. No.: 15/343,381

(22) Filed: Nov. 4, 2016

(65) Prior Publication Data

US 2017/0203871 A1 Jul. 20, 2017

Related U.S. Application Data

(60) Provisional application No. 62/279,955, filed on Jan. 18, 2016.

(51) Int. Cl.

| | |
|---|---|
| ***A61J 1/10*** | (2006.01) |
| ***B65B 3/00*** | (2006.01) |
| ***A61J 1/14*** | (2006.01) |

(52) U.S. Cl.

CPC . *A61J 1/10* (2013.01); *A61J 1/14* (2013.01); *A61J 1/1493* (2013.01); *B65B 3/003* (2013.01);

(Continued)

(58) Field of Classification Search

CPC .... A61J 1/10; A61J 1/14; A61J 1/1493; A61J 2205/10; A61J 2205/30

See application file for complete search history.

(56) References Cited

U.S. PATENT DOCUMENTS 4,024,648 A 5/1977 Bender
4,335,770 A * 6/1982 Kulle ..... A61J 1/10 220/375

(Continued)

FOREIGN PATENT DOCUMENTS

CN 203284363 U 11/2013
DE 102013003851 3/2014

(Continued)

OTHER PUBLICATIONS

U.S. Appl. No. 15/399,643, Notice of Allowance dated Apr. 5, 2019, 8 pgs.

(Continued)

*Primary Examiner* — Kai H Weng

(74) *Attorney, Agent, or Firm* — Gregory W. Smock; Christopher J. Buchko

(57) ABSTRACT

Systems and methods for protecting biological or other material from contamination through the steps of filling, freeze-drying, packaging, storing and use are disclosed. A system can include a flexible container, at least two membranes configured to transmit air or solvent vapor out of the flexible container, and a port to allow for the introduction or withdrawal of a material or substance into or out of the flexible container. The system can optionally further comprise a membrane frame supporting at least one of the membranes and engaged with at least one column member. The at least one column member can be configured to maintain the membranes and the membrane frame a spaced distance from one or more materials received within the flexible container. Upon application of a downward force, the at least one column member can assume a collapsed configuration. A method can include inserting a biological material into a flexible container, freeze-drying the biological material, moving the freeze-dried biological material to (Continued)

a portion of the flexible container that includes at least one port, and sealing the biological material within the portion.

13 Claims, 9 Drawing Sheets

(52) U.S. Cl.
CPC ..... *A61J 2205/10* (2013.01); *A61J 2205/30* (2013.01)

(56) References Cited

U.S. PATENT DOCUMENTS

| | | | |
|---|---|---|---|
| 4,453,320 | A | 6/1984 | Zimmermann et al. |
| 4,707,966 | A | 11/1987 | Weiler et al. |
| 4,813,210 | A | 3/1989 | Masuda et al. |
| 4,994,057 | A | 2/1991 | Carmen et al. |
| 5,174,042 | A | 12/1992 | Tomizawa et al. |
| 5,309,649 | A | 5/1994 | Bergmann et al. |
| 5,514,123 | A | 5/1996 | Adolf et al. |
| 5,596,814 | A | 1/1997 | Zingle et al. |
| 5,894,949 | A | 4/1999 | Taskis et al. |
| 5,937,536 | A | 8/1999 | Kieselbach et al. |
| 5,958,778 | A | 9/1999 | Kidd |
| 6,375,028 | B1 | 4/2002 | Smith |
| 6,381,870 | B1 | 5/2002 | Kohlman et al. |
| 6,517,526 | B1 | 2/2003 | Tamari |
| 6,764,481 | B1 | 7/2004 | Inada et al. |
| 6,773,425 | B1 | 8/2004 | Tamari |
| 6,981,337 | B2 | 1/2006 | Jones et al. |
| 7,363,726 | B2 | 4/2008 | Wang et al. |
| 7,776,022 | B2 | 8/2010 | McCarthy et al. |
| 7,966,746 | B2 | 6/2011 | Py |
| 8,013,022 | B2 | 9/2011 | DeAngelo et al. |
| 8,076,034 | B1 | 12/2011 | Lassila et al. |
| 8,449,520 | B2 | 5/2013 | Pepper et al. |
| 8,512,428 | B2 | 8/2013 | Ueki et al. |
| 8,518,452 | B2 | 8/2013 | Bjornstrup et al. |
| 8,555,520 | B2 | 10/2013 | Hedberg |
| 9,347,707 | B2 | 5/2016 | Struschka et al. |
| 9,561,893 | B2 | 2/2017 | Root et al. |
| 9,739,532 | B2 | 8/2017 | Baugh et al. |
| 9,796,273 | B2 | 10/2017 | Ragazzini |
| 9,801,784 | B2 | 10/2017 | Yoshida et al. |
| 9,863,699 | B2 | 1/2018 | Corbin et al. |
| 9,863,700 | B2 | 1/2018 | Pedersen et al. |
| 9,863,701 | B2 | 1/2018 | Robinson |
| 9,931,458 | B1 | 4/2018 | Naro |
| 10,300,444 | B2 | 5/2019 | Prytz |
| 10,377,520 | B2 | 8/2019 | Root et al. |
| 2007/0219524 | A1* | 9/2007 | Burnouf ..... A61J 1/10 604/408 |
| 2008/0234654 | A1 | 9/2008 | McCarthy et al. |
| 2008/0256822 | A1 | 10/2008 | Suzuki et al. |
| 2009/0107001 | A1 | 4/2009 | McCarthy |
| 2009/0113753 | A1 | 5/2009 | Pepper et al. |
| 2009/0325771 | A1* | 12/2009 | Inoue ..... A61J 1/10 493/210 |
| 2014/0360891 | A1 | 12/2014 | Kline et al. |
| 2015/0158652 | A1 | 6/2015 | Root et al. |
| 2015/0231031 | A1* | 8/2015 | Hayakawa ..... A61J 1/202 604/404 |
| 2015/0354894 | A1 | 12/2015 | Corbin et al. |
| 2017/0113824 | A1 | 4/2017 | Root et al. |
| 2019/0241300 | A1 | 8/2019 | Root et al. |

FOREIGN PATENT DOCUMENTS

| | | | |
|---|---|---|---|
| EP | 0854911 | B1 | 11/2004 |
| JP | H07165252 | A | 6/1995 |
| WO | 1995027180 | A1 | 10/1995 |
| WO | 1996006018 | A1 | 2/1996 |
| WO | 1996031748 | A1 | 10/1996 |
| WO | 2008140747 | A1 | 11/2008 |
| WO | 2010033169 | A1 | 3/2010 |
| WO | 2015191599 | A2 | 12/2015 |

OTHER PUBLICATIONS

U.S. Appl. No. 16/386,026, non-final office action dated Jul. 16, 2020.

European Search Report dated Jul. 17, 2020 in European Application No. 20159141.9.

* cited by examiner

SYSTEM AND METHOD FOR FREEZE-DRYING AND PACKAGING

CLAIM OF PRIORITY

This non-provisional patent document claims the benefit of priority under 35 U.S.C. § 119(e) to U.S. Provisional Patent Application Ser. No. 62/279,955, entitled "SYSTEM AND METHOD FOR FREEZE-DRYING AND PACKAGING" and filed on Jan. 18, 2016, which is herein incorporated by reference in its entirety.

TECHNICAL FIELD

This patent document pertains to a system and method for, among other things, freeze-drying and packaging a material under aseptic or pathogen-reduced conditions.

BACKGROUND

Dry storage can increase the shelf life and convenience of biological material and its use. Lyophilization is a process for drying heat-sensitive substances, such as biological materials, by freezing the substances and then subliming the ice or other frozen solvent in a high vacuum.

It can be necessary to keep biological material free from micro-organisms and other contaminants to avoid decomposition of the material and to prevent possible infections when the material is used. Biological material can be exposed to contaminants during transportation to and from a freeze-dryer. As a result, the operating area in which freeze-drying is to be carried out can undergo sterilization treatment to minimize exposure of the biological material to contaminants. This adds to the labor and costs associated with freeze-drying.

Many freeze-drying processes involve placing open containers of biological material in the freeze-dryer. The containers remain open to the environment until the freeze-drying process is complete to allow a path for solvent vapor to be removed from the biological material. This practice exposes the biological material to potential contamination during the freeze-drying process. To minimize the opportunity for contamination during the freeze-drying process, the freeze-drying equipment can be sterilized using steam or chemicals before loading each new batch of biological material to be processed. This, too, adds to the labor and costs associated with freeze-drying.

Moreover, using existing systems and methods, freeze-dried biological material needs to be repackaged after being dried. This repackaging presents another opportunity to introduce contaminants into the biological material and further adds to the labor and costs associated with freeze-drying.

OVERVIEW

The present inventors recognize, among other things, that a need exists for a system and method that addresses the concerns of material contamination by freeze-drying equipment, the area surrounding the freeze-drying equipment, and the repackaging of freeze-dried product. The inventors recognize that biological material such as blood plasma is associated with a risk of contamination anytime it is exposed to the environment. The inventors also recognize that the system and method should be economical and practical on production and use scales.

The present subject matter provides systems and methods for protecting biological material, for example, from contamination through the steps of filling, freeze-drying, packaging, storing and use. A system can include a flexible container, at least two membranes configured to transmit air or solvent vapor out of the flexible container, and a port to allow for the introduction or withdrawal of a material or substance into or out of the flexible container. The system can optionally further comprise a membrane frame supporting at least one of the membranes and engaged with at least one column member. The at least one column member can be configured to maintain the membranes and the membrane frame a spaced distance from one or more materials received within the flexible container. Upon application of a downward force, the at least one column member can assume a collapsed configuration. A method can include inserting a biological material into a flexible container, freeze-drying the biological material, moving the freeze-dried biological material to a portion of the flexible container that includes at least one port, and sealing the biological material within the portion.

These and other examples and features of the present system or method will be set forth, at least in part, in the following Detailed Description. This Overview is intended to provide non-limiting examples of the present subject matter—it is not intended to provide an exclusive or exhaustive explanation. The Detailed Description below is included to provide further information about the present system or method.

BRIEF DESCRIPTION OF THE DRAWINGS

In the drawings, like numerals can be used to describe similar features and components throughout the several views. The drawings illustrate generally, by way of example but not by way of limitation, various embodiments discussed in the present patent document.

Figure 1:
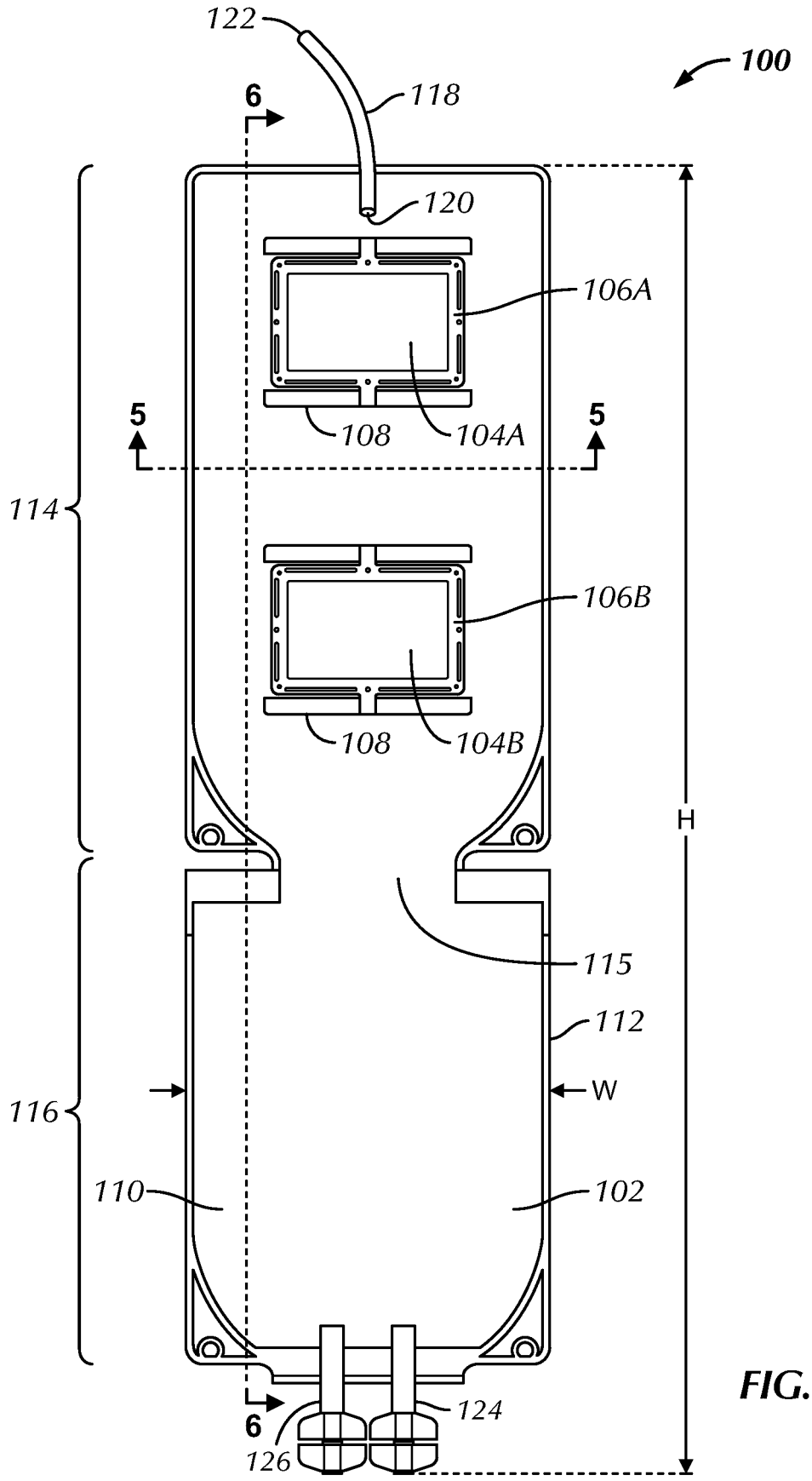
FIGS. 1 and 2 illustrate front elevational views of a system, as constructed in accordance with at least two embodiments.

The drawing figures are not necessarily to scale. Certain features and components may be shown exaggerated in scale or in schematic form and some details may not be shown in the interest of clarity and conciseness.

DETAILED DESCRIPTION

The present subject matter includes a method that protects material from contamination through the steps of filling, freeze-drying, packaging, storing and use. The method can include inserting a material into a flexible container, freeze-drying the material, moving the freeze-dried material to a portion of the flexible container that includes at least one port, and sealing the material within the portion. The method can be performed using a system as shown in any one or any combination of the drawings described herein. The system provides a practical, durable freeze-drying container including at least two membranes that provide sufficient solvent vapor flow, resistance to breakage, wetting and abrasion, and aseptic barrier properties.

Figure 2:
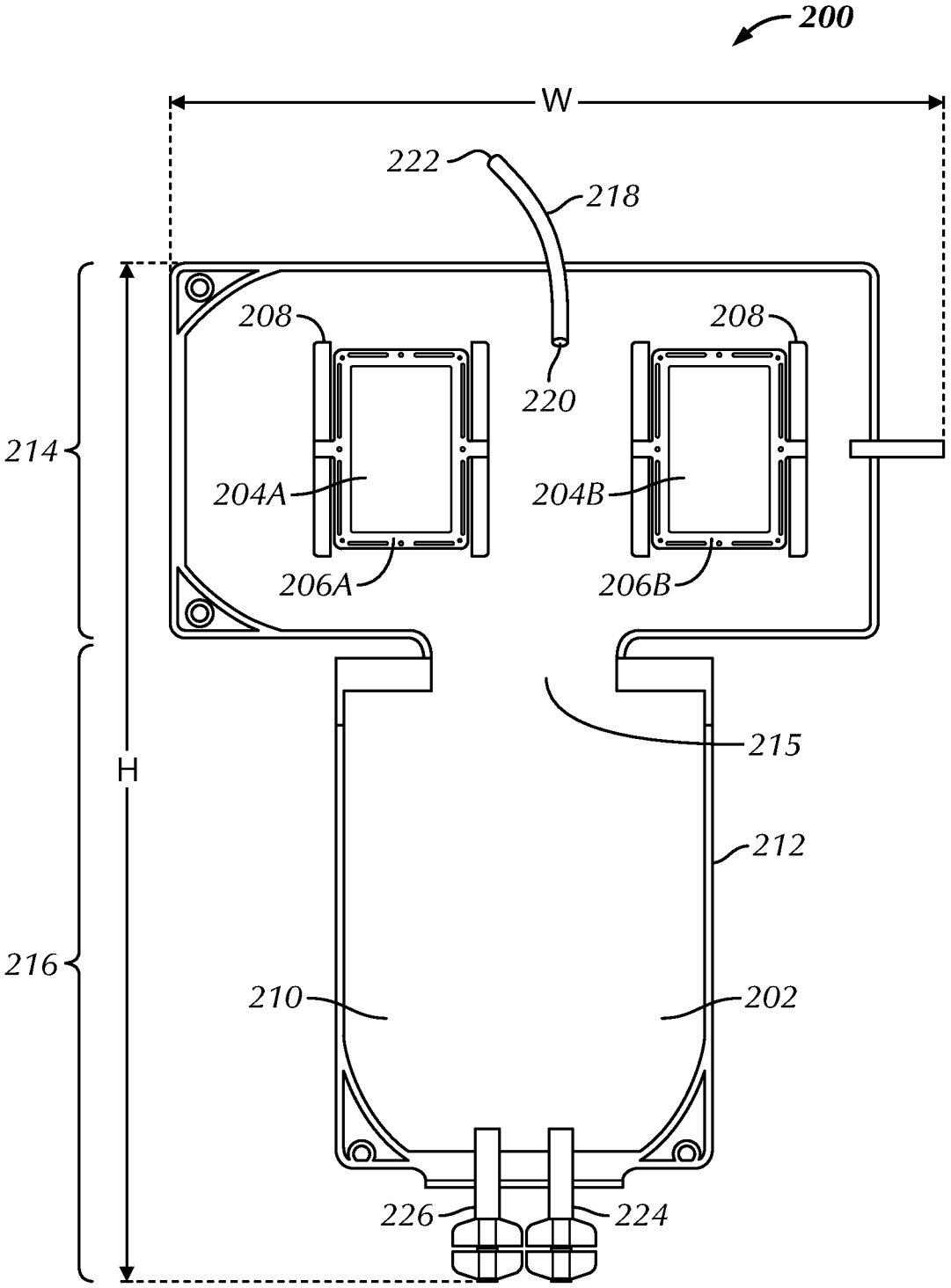

FIGS. 1 and 2 illustrate front elevational views of two systems 100, 200 configured to house a material such as blood plasma from a single donor. Each system can include a flexible container 102, 202, at least two membranes 104A, 104B, 204A, 204B, and a port 118, 218, 124, 224, 126, 226 to allow for the introduction or withdrawal of a material or substance into or out of the flexible container 102, 202.

The flexible container 102, 202 can be used in a freeze-drying process. Biological material to be freeze-dried can be received within the flexible container 102, 202 prior to lyophilization. The flexible container 102, 202 can include a front side 110, 210 and a back side 112, 212, and can define a height H of a first dimension and a width W of a second dimension. The second dimension can be smaller than the first dimension. In an example, the height H can be 7-25 inches, such as about 20 inches, and the width W can be 3-15 inches, such as about 6 inches. The terms "front" and "back," as used herein, refer to opposing walls of the flexible container 102, 202 when it is placed on a freeze-dryer shelf with the membranes 104A, 104B, 204A, 204B facing upward. The height H or width W can have an intermediate location separating the flexible container into a first portion 114, 214 and a second portion 116, 216. The intermediate location can separate the flexible container 102, 202 such that the first portion 114, 214 is greater in size (e.g., volume capacity) than the second portion 116, 216. A funnel 115, 215 can be integrated into the flexible container 102, 202 at or near the intermediate location to guide material from the first portion 114, 214 to the second portion 116, 216.

The flexible container 102, 202 can include a sealable material made of an inert medical grade plastic material such as polyvinyl chloride (PVC), polypropylene or high density polypropylene, which is designed to resist tearing and puncturing that can be encountered in normal handling. The sealable material can be selected to be transparent to allow visual inspection of the biological material within the flexible container 102, 202 and can be available in a variety of sizes, such as about 10 mL up to about 10 L. The front 110, 210 and back 112, 212 sides of the flexible container 102, 202 can be heat-sealed or, alternatively, ultrasonically or radio-frequency (RF) welded to one another along their outer perimeters. Thermal sealing can be performed by Dravon Medical of Clackamas, Oreg.

The membranes 104A, 104B, 204A, 204B can be located within the first portion 114, 214 of the flexible container 102, 202 and can have a height of 1-3 inches, such as about 2 inches, and a width of 2-4 inches, such as about 3 inches. The membranes 104A, 104B, 204A, 204B can be configured to transmit air or solvent vapor out of, and resist liquid and contaminant passage into, the flexible container 102, 202. Each membrane's material can be selected for its combination of high aseptic barrier properties, high resistance to penetration and wetting by liquid water, and low resistance to solvent vapor flow. In an example, the material of each membrane can include polytetrafluoroethylene (PTFE), which is available from Porex Corporation of Fairburn, Ga. The membranes 104A, 104B, 204A, 204B can be separate from, but attachable to, the front side 110, 210 of the flexible container 102, 202 by way of one or more membrane frames 106A, 106B, 206A, 206B. In such examples, the membrane material should have the ability to seal reliably to a membrane frame material.

The membrane frames 106A, 106B, 206A, 206B can be coupled to the membranes 104A, 104B, 204A, 204B around their perimeters and the front side 110, 210 of the flexible container 102, 202. The membrane frames can provide strength and support to the membranes. The membrane frames 106A, 106B, 206A, 206B can be engaged with at least one collapsible column member 108, 208 to prevent the membranes 104A, 104B, 204A, 204B from contacting biological material located within the flexible container 102, 202 during the lyophilization process. The at least one column member 108, 208 can be configured to support the membranes 104A, 104B, 204A, 204B and the membrane frames 106A, 106B, 206A, 206B a spaced distance from the back side 112, 212 of the flexible container 102, 202. The membrane frames and column members can be manufactured by Tauris Manufacturing of Minneapolis, Minn.

The port 118, 218, 124, 224, 126, 226 can include one or a plurality of ports to allow for the introduction or withdrawal of a material or substance into or out of the flexible container 102, 202. A material entry port 118, 218 can be coupled to the first portion 114, 214 of the flexible container 102, 202 and can be used to insert the biological material and, optionally, other materials within the container. In an example, one or more pH-adjusting substances can be inserted into the flexible container 102, 202 and combined with the biological material to affect a predetermined pH value range in a reconstituted material solution. In an example, the material entry port can include a tube extending from a first end 120, 220, coupled to the first side 110, 210 of the flexible container 102, 202, to a second end 122, 222, couplable to a biological material source. A reconstitution port 124, 224 and an application port 126, 226 can be coupled to an outer perimeter of the second portion 116, 216 of the flexible container 102, 202 and can be in fluid communication with an interior of the container. These ports 124, 224, 126, 226 can allow a user to introduce a reconstitution (or rehydration) solution into the flexible container 102, 202 and administer a rehydrated product (e.g., reconstituted biological material) to a patient, respectively, in an aseptic manner.

The systems 100, 200, including the flexible container 102, 202, the membranes 104A, 104B, 204A, 204B, the membrane frames 106A, 106B, 206A, 206B, the at least one column member 108, 208 and the ports 118, 218, 124, 224, 126, 226, can be sterilized prior to use.

Figure 3:
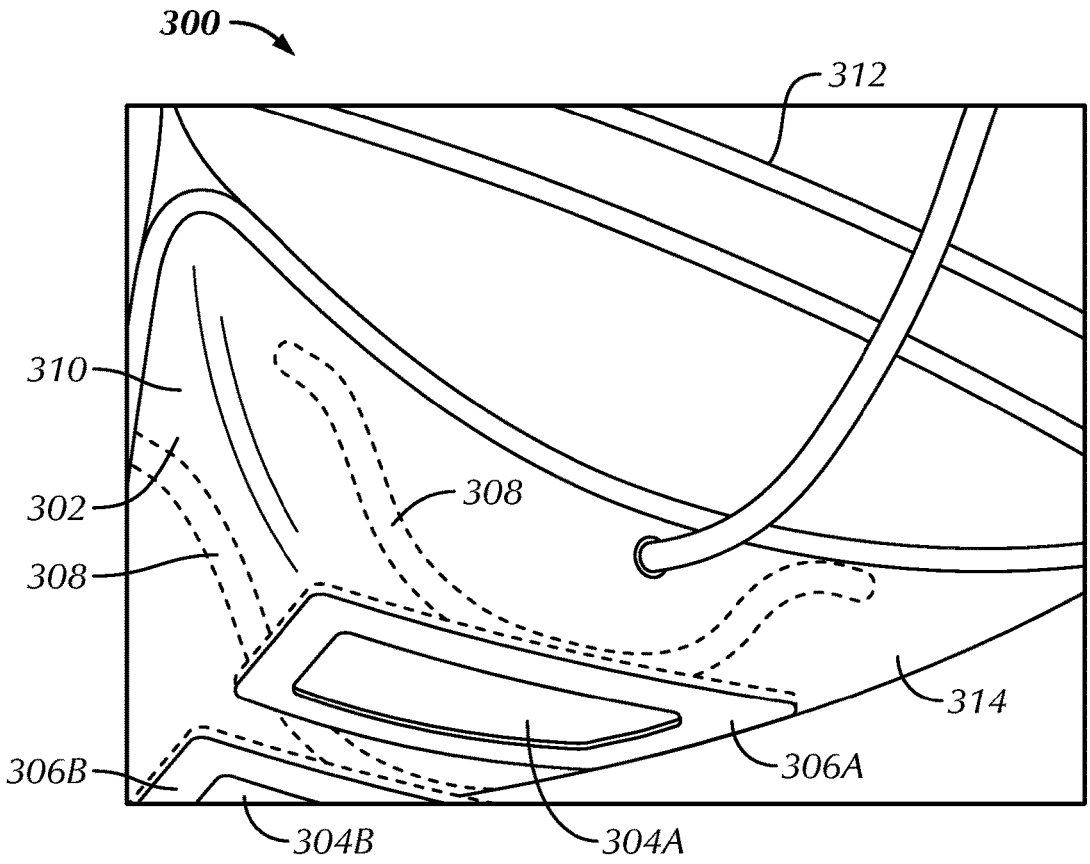
FIG. 3 illustrates an elevational view of a first portion of a system, as constructed in accordance with at least one embodiment.
Figure 4:
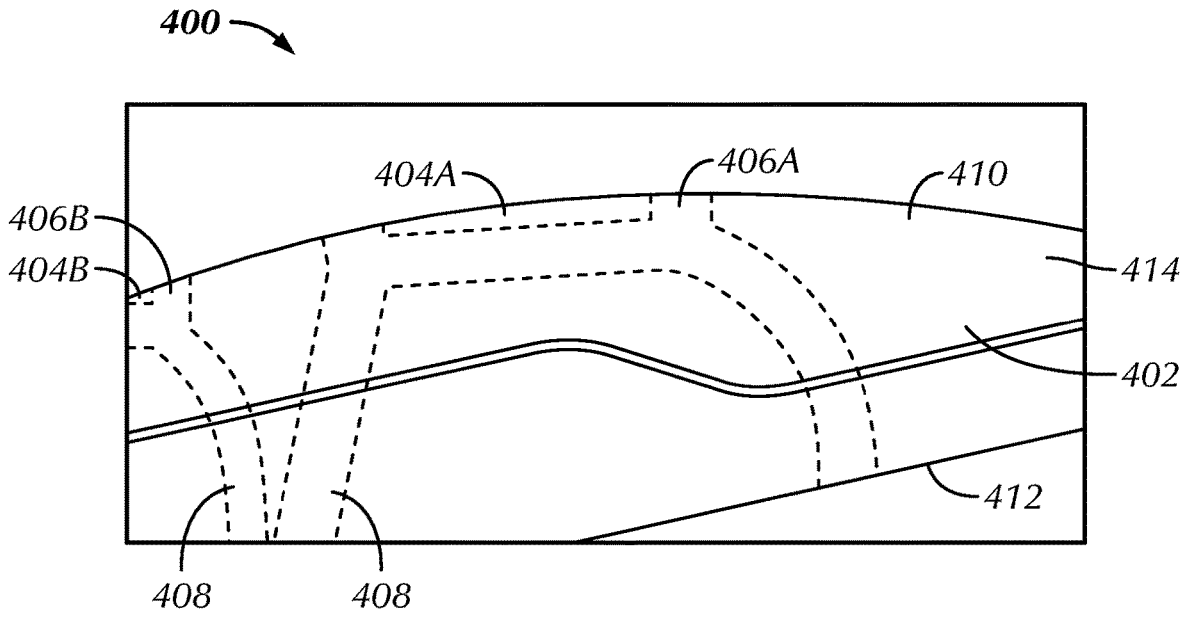
FIG. 4 illustrates a side view of a first portion of a system, as constructed in accordance with at least one embodiment.

FIGS. 3 and 4 illustrate elevational and side views, respectively, of a first portion 314, 414 of a system 300, 400. Each system 300, 400 can include a flexible container 302, 402 having a front side 310, 410 and a back side 312, 412, at least two membranes 304A, 304B, 404A, 404B, membrane frames 306A, 306B, 406A, 406B and column members 308, 408.

Containers without vertical sidewalls can include contents that contact a membrane resulting in the material freezing against the membrane. The material can dry against and plug the membrane resulting in reduction of a lyophilization rate and a reduced usefulness of the system. As such, it can be important to prevent the membrane from contacting container contents (e.g., biological material). Advantageously, the column members 308, 408 can maintain one or more of the front side 310, 410 of the flexible container 302, 402, the membranes 304A, 304B, 404A, 404B, and the membrane frames 306A, 306B, 406A, 406B above any contents during lyophilization. The column members can be sufficiently stiff to support the front side, the membranes, and the membrane frames above the contents, yet sufficiently deformable or pliable to collapse subsequent to lyophilization, as sequentially illustrated in FIGS. 10-12. The column members 308, 408 can have various linear or non-linear configurations, including a bent leg shape, a helical spring shape or a tubular shape.

Figure 5:
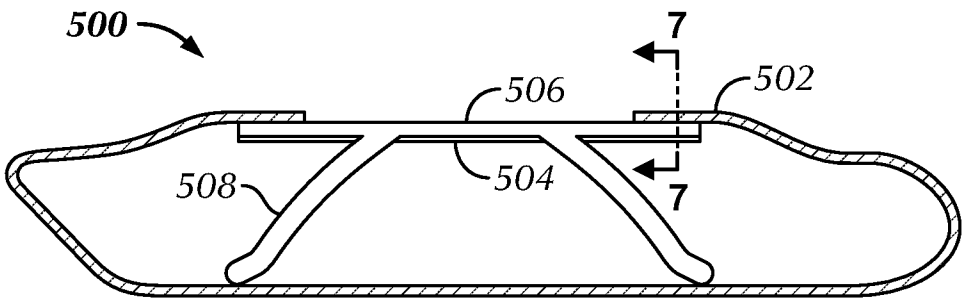
FIG. 5 illustrates a cross-sectional view of a first portion of a system, such as a cross-section taken along line 5-5 of FIG. 1.
Figure 6:
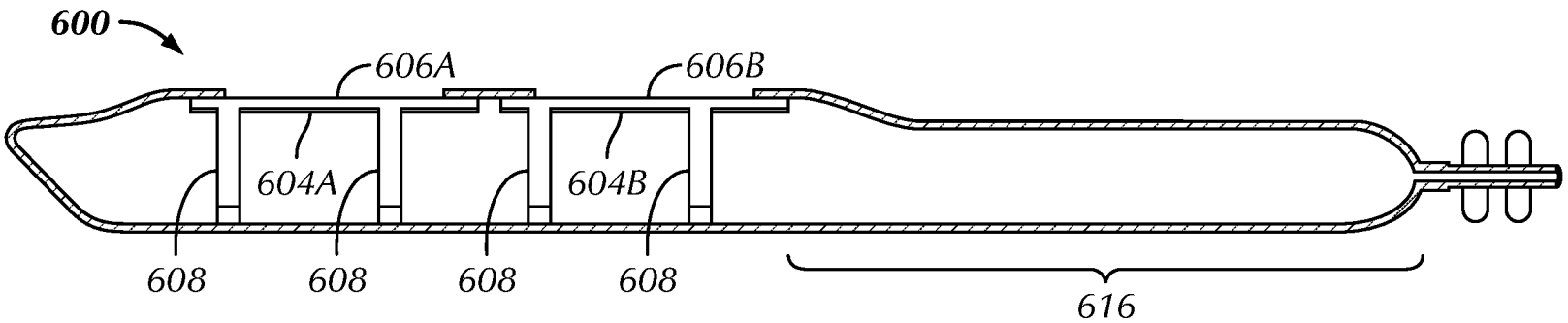
FIG. 6 illustrates a cross-sectional view of the system, such as a cross-section taken along line 6-6 of FIG. 1.

FIGS. 5 and 6 illustrate cross-sectional views of a system 500, 600 taken along lines 5-5 and 6-6 of FIG. 1, respectively. As shown in FIG. 5, a widthwise cross-section of the flexible container 502 can assume an ellipsoid shape in the absence of vertical sidewalls. Flexible containers without vertical sidewalls can be efficiently and economically manufactured using a single, outer perimeter sealing step. While not shown, the second portion 616 of the flexible container 602 can be folded or rolled to reduce the system's 600 footprint during lyophilization. Post-lyophilization, the folded or rolled container portion can be expanded to provide greater volume within the interior of the container 602. With the addition of at least one column member 508, 608, membranes 504, 604A, 604B and membrane frames 506, 606A, 606B can be supported above any material contents, as shown in FIGS. 5 and 6.

Figure 7:
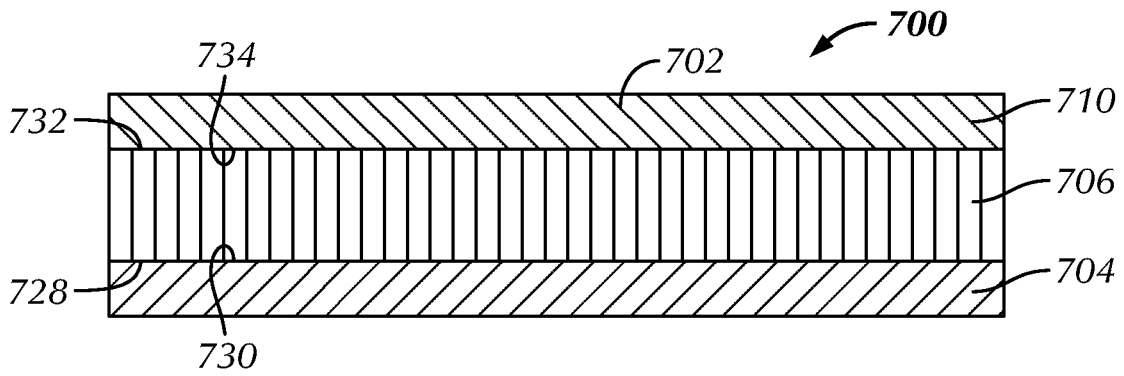
FIG. 7 illustrates a cross-sectional view of a membrane, a membrane frame and a flexible container, such as a cross-section taken along line 7-7 of FIG. 5.

FIG. 7 illustrates a cross-sectional view of a system 700 taken along line 7-7 of FIG. 5. The system 700 can include a front side 710 of a flexible container 702, a membrane 704 and a membrane frame 706. To assemble these portions of the system 700, the membrane frame 706 can be laid on top of the membrane 704, and the front side 710 of the flexible container 702 can be laid on top of both the membrane 704 and the membrane frame 706. The three layers can then be adhesive coupled or bonded with a heat-sealer, an ultrasonic welder, or an RF welder to bond a bottom surface 728 of the membrane frame 706 to a top surface 730 of the membrane and a top surface 732 of the membrane frame 706 to a bottom surface 734 of the front side 710 of the flexible container 702. For aseptic reasons, it can be important that the seals between the membrane 704, the membrane frame 706 and the flexible container 702 are fluid and vapor tight.

The system 700 can include one or more magnetic members or one or more hook members coupled to or integrated with the flexible container 702, the membrane 704 or the membrane frame 706. The magnetic or hook members can interact with an external magnetic member or an external support to maintain the membrane 704 above any material contents within the flexible container. The one or more magnetic or hook members can be used alone or in conjunction with the at least one column member described elsewhere in this patent document.

Figure 8:
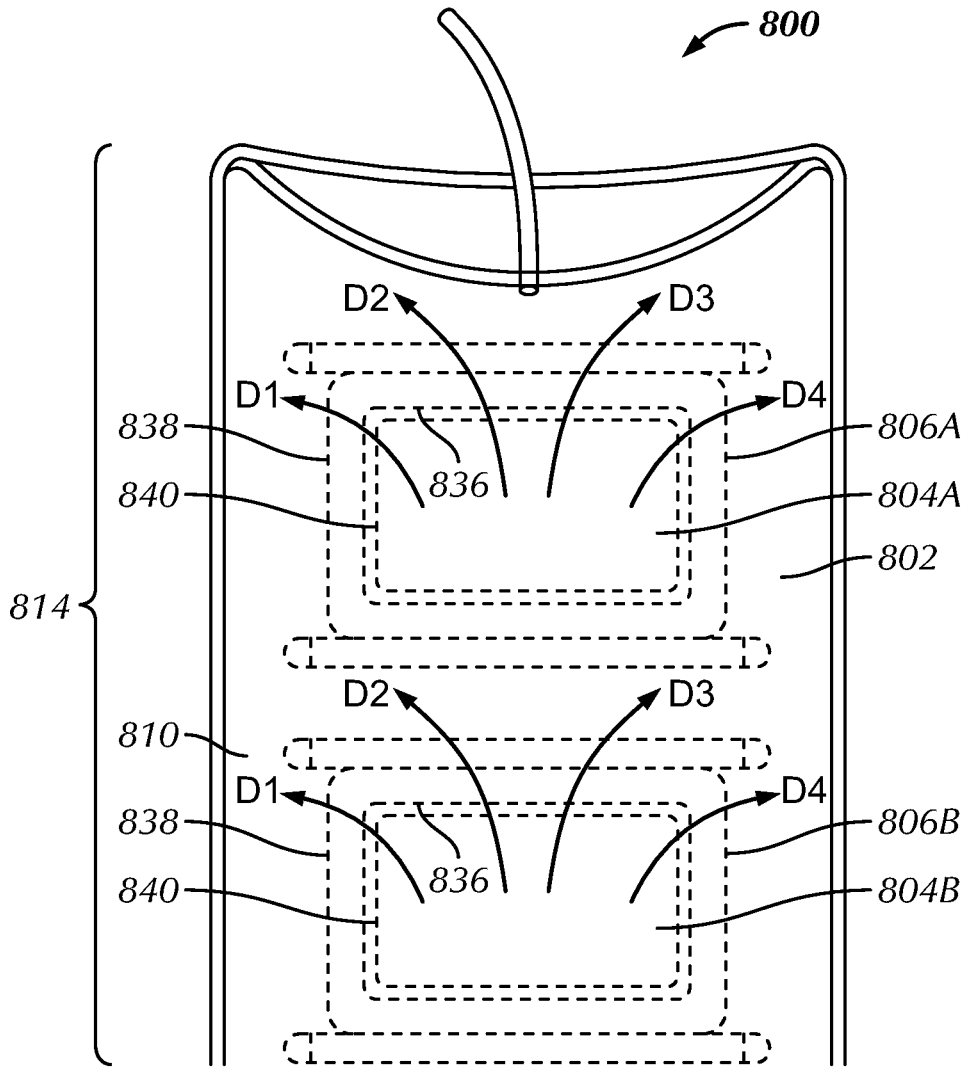
FIG. 8 illustrates an elevational view of a first portion of a system, as constructed in accordance with at least one embodiment.

FIG. 8 illustrates an elevational view of a first portion 814 of a system 800. The system 800 can include a front side 810 of a flexible container 802, at least two membranes 804A, 804B, and at least two membrane frames 806A, 806B. The front side 810 of the flexible container 802 and the membranes 804A, 804B can be supported along their peripheries by the stiffer membrane frames 806A, 806B. The membranes 804A, 804B can be sized such that their outer peripheries are larger than inner peripheries 836 of the membrane frames 806A, 806B and smaller than, or equal to, outer peripheries 838 of the frames. A void in the front side 810 of the flexible container 802 can have a periphery that is smaller than the outer peripheries 838 of the membrane frames 806A, 806B and larger than, or equal to, the inner peripheries 736 of the frames.

During lyophilization, solvent vapor can pass out of the flexible container 802 through the membranes 804A, 804B in a variety of directions, such as one or more of $D_1$, $D_2$, $D_3$, and $D_4$. Particulate biological material can be retained within the flexible container 802 and contamination from the container's surroundings can be excluded by the aseptic barrier properties of the membranes 804A, 804B. The membranes 804A, 804B can be made of any vent material that is solvent vapor permeable and that provides effective resistance to bacterial penetration. Aseptic papers, woven or non-woven polymeric fabrics such as spun-bonded polyolefin, porous polymer membranes such as PTFE and expanded PTFE, glass fiber, nitrocellulose, mixed cellulose esters, polyvinylidene fluoride (PVDF), polyethersulfone, polycarbonate, nylon, polypropylene, and PVC are examples. PTFE can be a preferred membrane material based on its combination of hydrophobicity and solvent vapor flow for a given nominal pore size.

Optionally, a removable cover 840 (shown in phantom) can be added to an upward-facing surface of each membrane 804A, 804B. The removable cover 840 can protect the membranes 804A, 804B during any processing before lyophilization. The removable cover 840 can include a tab that extends beyond the inner 836 or outer 838 peripheries of the membrane frames 806A, 806B to allow a user to grasp and remove the cover to expose the membranes 804A, 804B.

Figure 9:
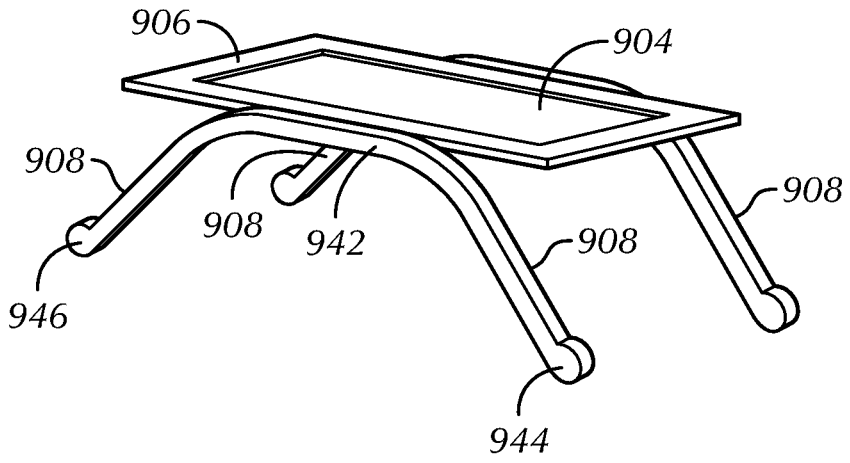
FIG. 9 illustrates a front elevational view of a membrane, a membrane frame, and at least one column member in a relaxed configuration, as constructed in accordance with at least one embodiment.

FIG. 9 illustrates a front elevational view of a membrane 904, a membrane frame 906 and at least one column member 908 in a relaxed configuration. The at least one column member 908 can be sized, shaped and positioned to support the membrane 904 and the membrane frame 906 above any contents (e.g., biological material) within a flexible container. The at least one column member 908 can include a first end 942 engaged with the membrane frame 906 and a second end 944 or a third end 946 in contact with a surface of a back side of the flexible container. Alternatively, the at least one column member 908 can be configured to externally support the membrane 904 and the membrane frame 906 above any contents within the flexible container. In such an example, the second end 944 or the third end 946 of the at least one column member 908 can contact a surface external to the flexible container.

In the example shown, the at least one column member 908 can define a U-shape, with the curvature of the U-shape engaged with the membrane frame 906. The at least one column member 908 can be separate from or integral with the membrane frame 906. In various examples, the at least one column member 908 can be molded from a thermoplastic such as acrylonitrile butadiene styrene (ABS), PVC or polypropylene or a metallic material.

Figure 10:
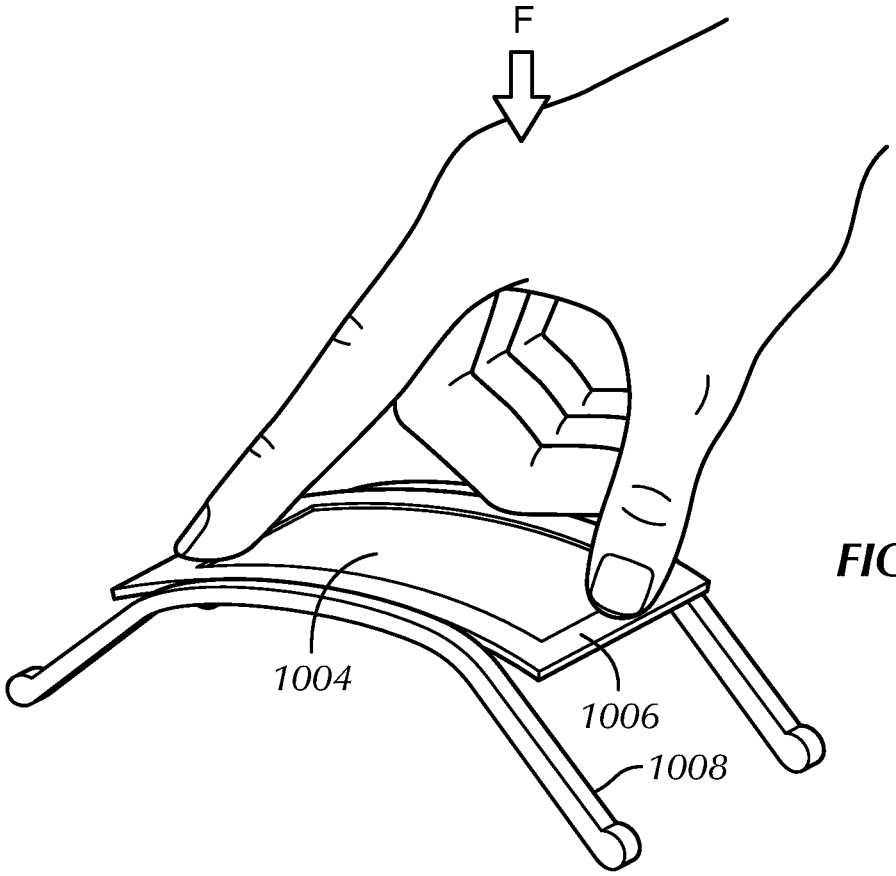
FIGS. 10-12 illustrate sequential perspective views of a membrane, a membrane frame, and at least one column member subjected to a force F in a downward direction, as constructed in accordance with at least one embodiment.
Figure 11:
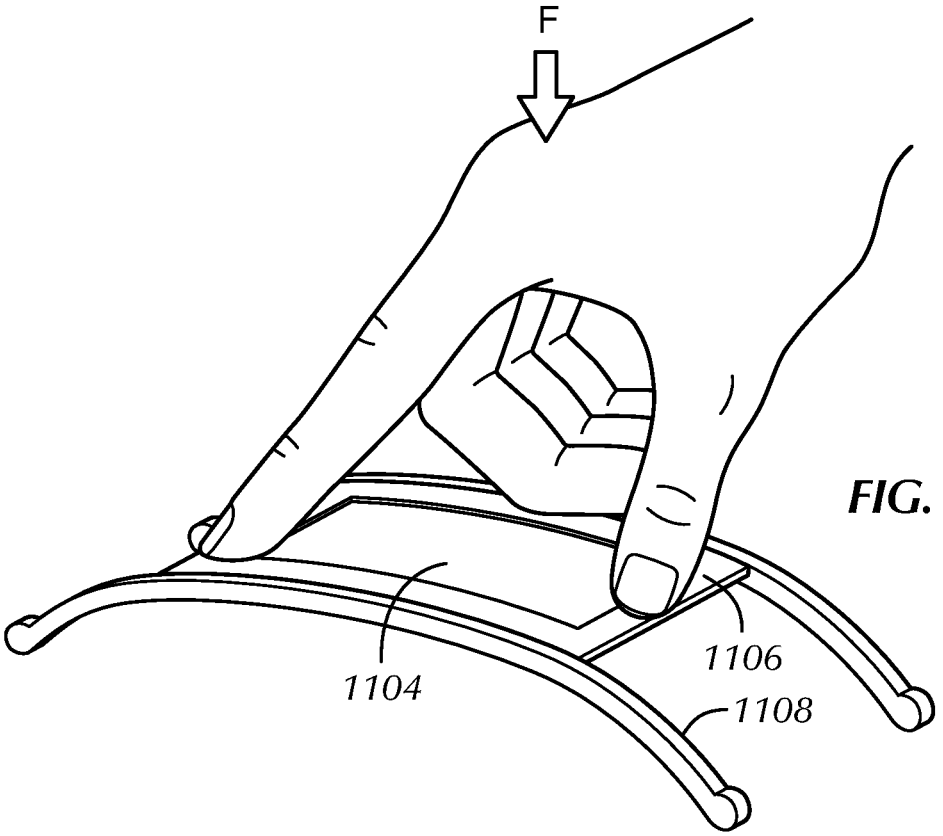
Figure 12:
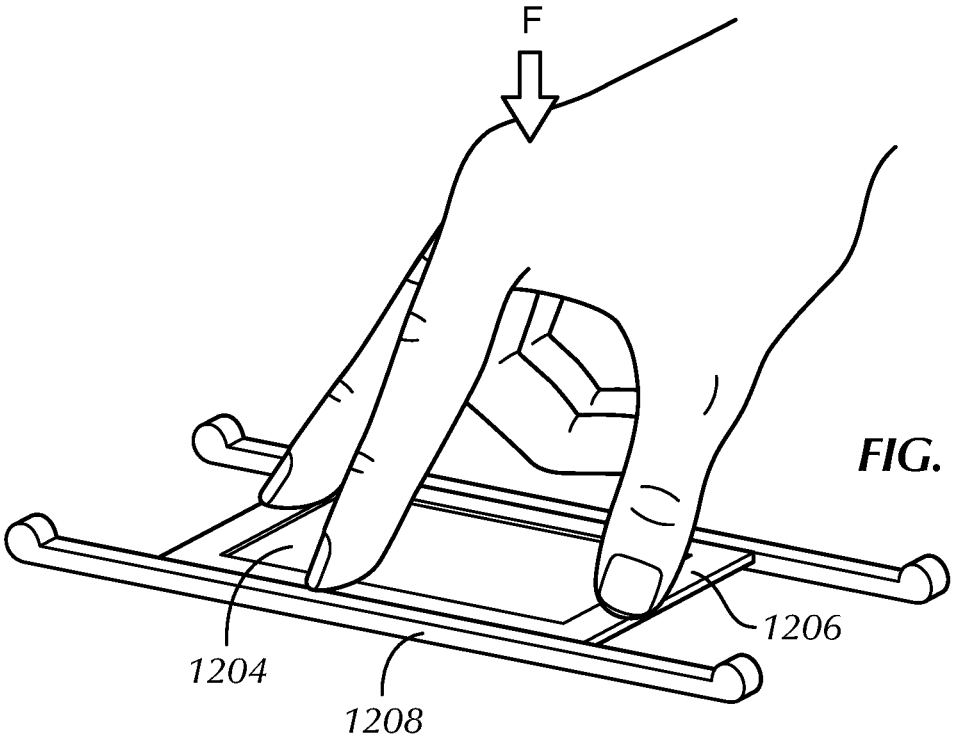

FIGS. 10-12 illustrate sequential perspective views of a membrane 1004, 1104, 1204, a membrane frame 1006, 1106, 1206 and at least one column member 1008, 1108, 1208 subjected to a downward force F. As shown, the at least one column member 1008, 1108, 1208 can include a plurality of column members configured to change shape or position relative to the membrane frame 1006, 1106, 1206 upon application of the downward force F. In an example, the plurality of column members 1008, 1108, 1208 can be deformed into a planar orientation with the membrane frame 1006, 1106, 1206, as shown in FIG. 12. Optionally, the at least one column member 1008, 1108, 1208 can include a recess that allows a portion of the column member to break-off upon application of the downward force F. Through the breaking-off of the portion of the column member, the membrane frame 1006, 1106, 1206 can more easily contact a surface of a back side of a flexible container.

Figure 13:
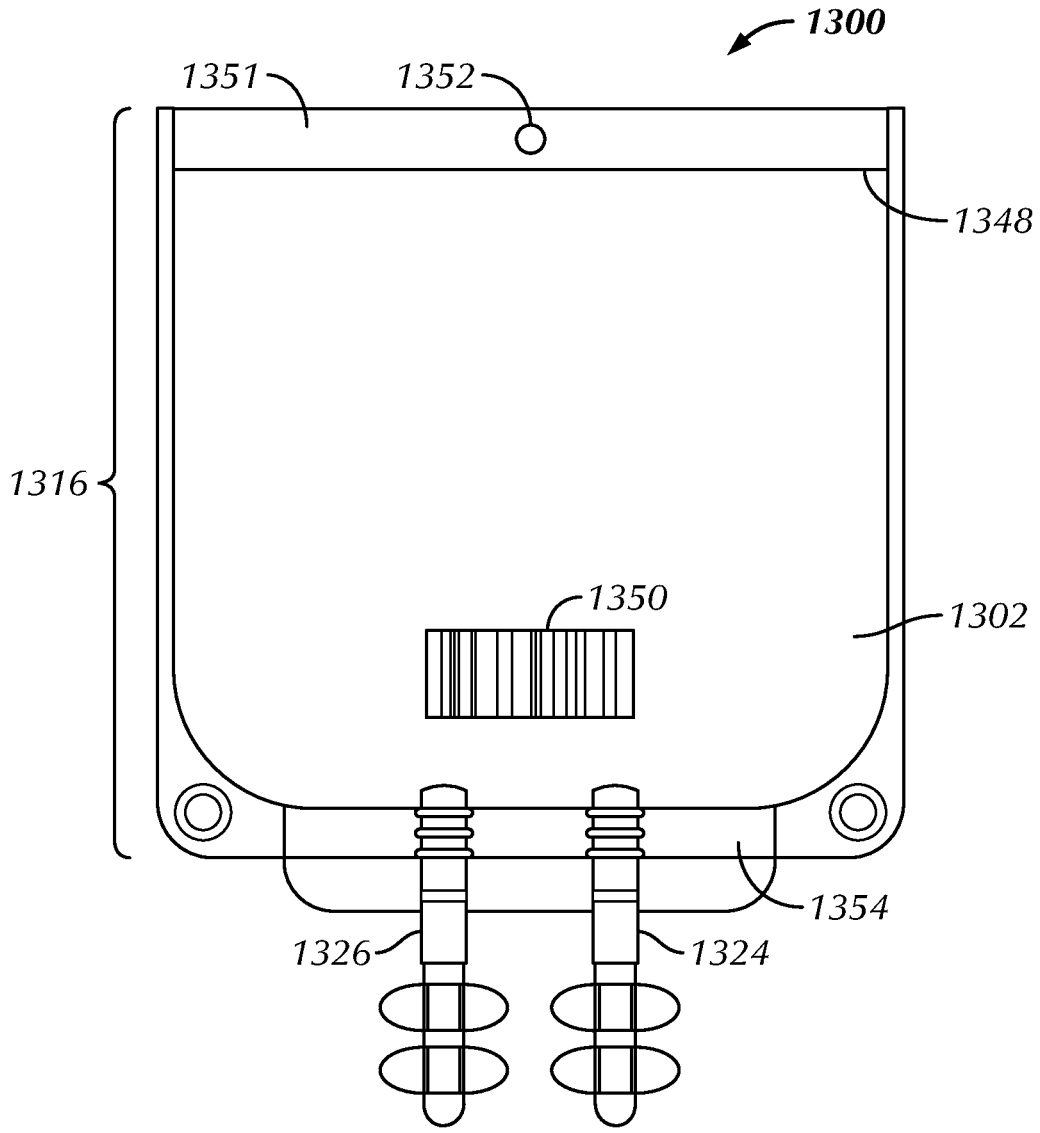
FIG. 13 illustrates an elevational view of a second portion of a system, as constructed in accordance with at least one embodiment.

FIG. 13 illustrates an elevational view of a second portion 1316 of a system 1300. The system 1300 can include a flexible container 1302, a reconstitution port 1324 and an application port 1326. The flexible container 1302 can contain a freeze-dried material such as freeze-dried biological material. In an example, the freeze-dried biological material is a blood plasma unit, which can include about 250-270 mL of blood plasma from a single donor. The blood plasma unit, for example, can be dried so that its moisture content is below about 5% weight/weight (w/w), which can be stored, transported, and later reconstituted and applied to a patient.

An advantage of a freeze-dried material is its storability for a comparably longer period of time at temperatures of about 0° C. (Celsius) up to room temperature and beyond, combined with its reduced weight due to reduced water content. Although a freeze-dried material requires reconstitution, the advantages are predominant in certain situations, especially in emergency medicine under difficult treatment conditions (e.g., in combat treating wounded warriors or in ambulances and helicopters treating civilian trauma) when the thawing of frozen biological material to be applied is time-consuming (e.g., around 15 minutes or more) and inconvenient.

Freeze-dried biological material can be packaged for storage in a container that presents a barrier to solvent vapor transmission, thereby minimizing the opportunity of rehydrating the dried contents. Advantageously, the flexible container 1302 can be sealed 1351 (e.g., using heat sealing, RF welding or ultrasonic welding) near an end 1348 of the second portion 1316, which can be located opposite the reconstitution 1324 and application 1326 ports, after the dried contents are moved to the second portion 1316. The size and configuration of the second portion 1316 of the flexible container 1302 can maintain the freeze-dried biological material prior to its reconstitution in a moisture-free environment, thereby accommodating long-term storage (e.g., 2 to 3 years at refrigerated temperatures and a plurality of months at room temperature) and retaining its desired qualities for transfusion.

In addition to storing the freeze-dried biological material, the second portion 1316 of the flexible container 1302 can be sized and configured to receive reconstitution liquid such as about 250 mL of water. In this way, the second portion 1316 of the flexible container 1302 can provide a single receptacle to store freeze-dried contents, rehydrate the dried contents, and apply the rehydrated product to a patient. The reconstitution 1324 and application 1326 ports can be thermally, ultrasonically, or adhesively coupled or RF welded to an outer perimeter of the second portion 1316 and oriented to be in fluid communication with an interior of the flexible container 1302 and its contents. The ports 1324, 1326 can include a diaphragm or other piercable membrane to maintain material sterility and prevent inadvertent flow out of the flexible container 1302. To ensure that the material within the flexible container 1302 can easily and completely empty out of the container, at least the application port 1326 can be positioned at a bottom end 1354 of the second portion 1316, opposite the seal 1351, when the container is suspended by a hang lumen 1352 located near the top end 1348.

Bar coding and tagging 1350 can be applied to the second portion 1316 of the flexible container 1302. The bar coding and tagging 1350 can, for example, reflect biological material identification, including blood plasma source, blood type, date of collection, etc., carried by the second portion 1316.

First aid is critical for the survival of a patient that has suffered a serious injury. For example, initial treatment of a severely wounded warrior in a combat situation can often mean the difference between life and death. While it is necessary to treat wounds and stop the bleeding of a patient, it is also important to ensure that the patient's body is capable of properly functioning. Thus, it is necessary to take steps to ensure that the patient's body is properly hydrated after losing fluids due to the wounds. The present system and method address this issue.

Using existing technology, fluids within a patient are typically replenished by intravenously delivering saline. While effective, research has indicated that delivery of blood plasma to the patient is even more effective in replenishing fluid to the patient. Processing, storage, and delivery of the blood plasma can be critical to preventing contamination of the plasma. An ideal way of delivering blood plasma is to store it in a freeze-dried form and reconstitute the blood plasma at the time it is administered to the patient.

Figure 14:
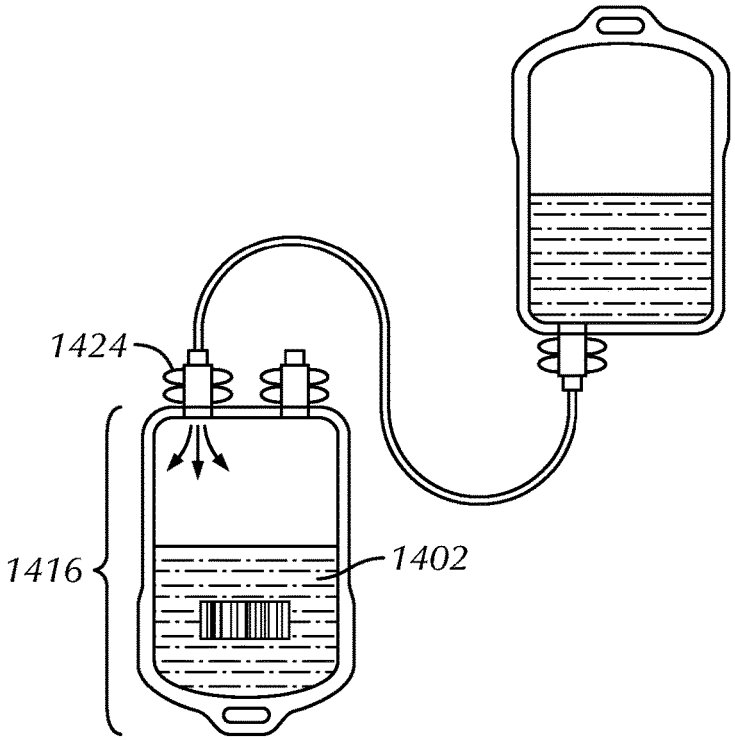
FIG. 14 illustrates a schematic view of reconstituting a freeze-dried material, as constructed in accordance with at least one embodiment.

FIG. 14 illustrates a schematic view of reconstituting a freeze-dried biological material such as blood plasma. The freeze-dried biological material can be stored in a second portion 1416 of a flexible container 1402. This portion 1416 of the flexible container 1402 can be sized to receive a reconstitution liquid (e.g., about 250 mL of water) through a reconstitution port 1424 for mixing with the freeze-dried biological material. In use, a needle or IV spike sized and configured to puncture a diaphragm or other piercable membrane within the reconstitution port 1424 can be used to establish fluid communication between the reconstitution liquid and the freeze-dried biological material. The freeze-dried biological material and the reconstitution liquid can then be passed back and forth within the flexible container 1402 until a desired degree of mixing occurs, at which time the mixture is ready for transfusion. More particularly, a caregiver can proceed to squeeze opposing ends or sides of the second portion 1416 of the flexible container 1402 to move and mix the freeze-dried biological material and the reconstitution liquid.

Figure 15:
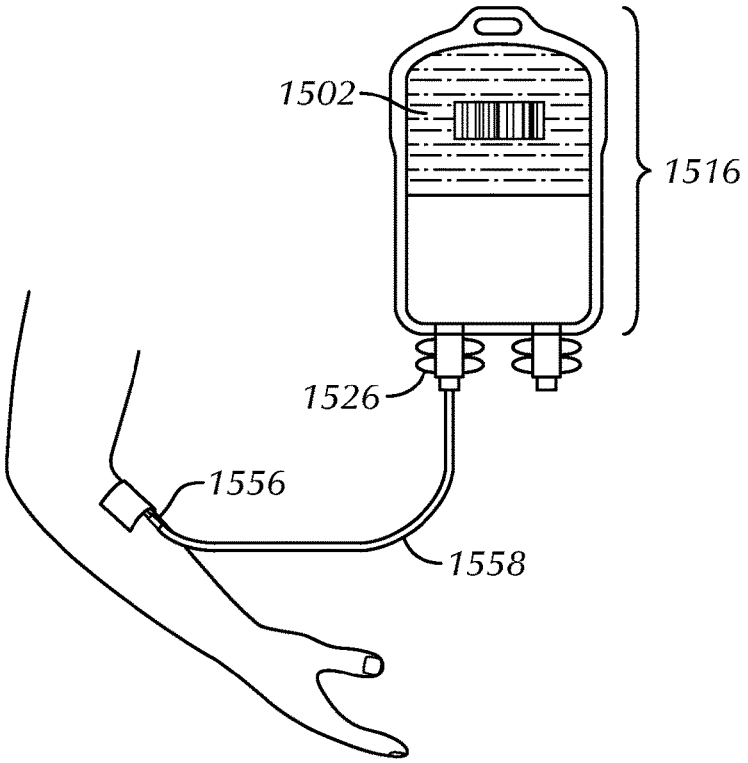
FIG. 15 illustrates a schematic view of applying a reconstituted material to a patient, as constructed in accordance with at least one embodiment.

FIG. 15 illustrates a schematic view of applying a reconstituted biological material such as reconstituted blood plasma to a patient. The reconstituted material can be administered by way of an application port 1526. An application set can include a phlebotomy needle 1556 for insertion into a vein, aseptic tubing 1558 connecting the needle 1556 to a second portion 1516 of a flexible container 1502 and its reconstituted biological material contents, and a needle or IV spike to puncture a diaphragm or other piercable membrane within the application port 1526.

Figure 16:
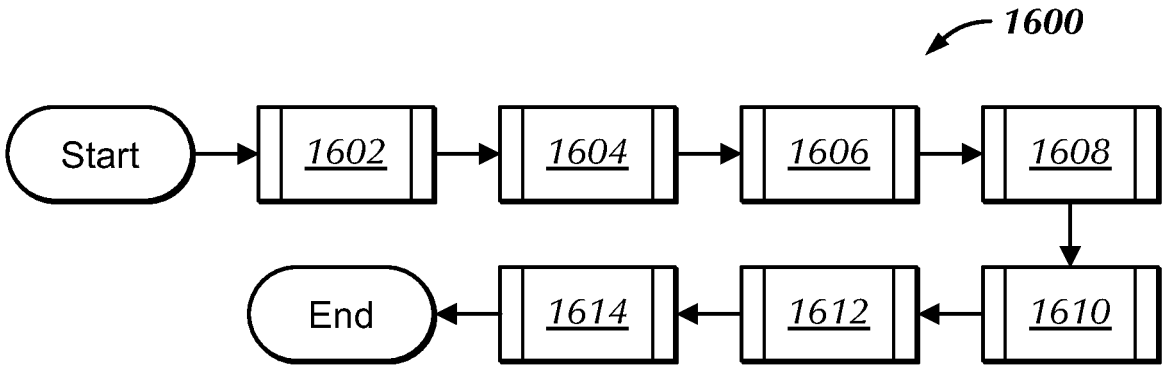
FIG. 16 illustrates a method of filling a flexible container with a material, freeze-drying the material, and packaging the material for later use, as constructed in accordance with at least one embodiment.

FIG. 16 illustrates a method 1600 of filling a flexible container with a biological material such as blood plasma, freeze-drying the blood plasma, and packaging the blood plasma for later use.

In operation 1602, a blood plasma source unit can be obtained. Blood plasma can be obtained from a single donor or a pooling of donors by collecting a unit of whole blood from the donor(s) in a closed system collection bag, followed by centrifugal separation of the blood plasma and its collection in an integrally connected transfer bag. The blood plasma can be obtained in individual units of about 270 mL, for example, shipped frozen and stored in a 20° C. freezer. Identification information, maintained by bar coding or other tagging means, can be supplied with each individual donor blood plasma unit for traceability purposes.

In operation 1604, the blood plasma source unit can be prepared for freeze-drying. The blood plasma unit can be removed from the freezer and any associated packaging can be discarded. The blood plasma unit can be transferred into a plasma thawing unit and allowed to thaw. The thawed blood plasma unit can be bar code scanned, for example, and an identification tag can be made. The identification tag can include unit specific information to maintain traceability of the blood plasma.

In operation 1606, the blood plasma can be transferred into a water-impermeable, vapor-permeable, aseptic, sealable flexible container. The flexible container and the blood plasma source unit can be coupled together using a material entry port in the form of aseptic tubing. The blood plasma can be transferred through the aseptic tubing using positive pressure. The total mass of the transferred blood plasma can be about 270 g, for example. Once the blood plasma has been transferred, a portion of the aseptic tubing can be thermally or otherwise sealed to protect the unit from contamination.

The flexible container can include a first side incorporating two or more membranes and a second side. The two sides can be spaced from one another by a membrane frame and at least one column member, a magnetic or hooking arrangement or through other means to avoid contact between the blood plasma and the membranes. The identification tag made in operation 1604 can be attached to the flexible container.

In operation 1608, the filled flexible container can be placed on a horizontally-oriented freeze-dryer tray such that the membranes are on top, facing upward, and the container can be freeze-dried. This placement of the membranes can allow for controlled and consistent conduction during the freeze-drying process, as air or solvent vapor can escape the flexible container through the membranes. Optionally, the filled flexible container can be placed on a vertically-oriented freeze-dryer tray and the membranes can be incorporated at any location on an upper, first portion of the container. After placing the flexible container on a shelf in a freeze-dryer chamber, the shelf can be cooled using a heating and cooling unit to preliminarily freeze the blood plasma to be dried. Alternatively, the filled flexible container to be freeze-dried can be pre-frozen using a separate unit (e.g., a −60° C. freezer) and arranged on the shelf.

Next, in operation 1610, the pressure inside the freeze-dryer can be reduced to sublimation dry the contents of the flexible container. The pressure inside the freeze-dryer can be reduced to about 100 mTorr to sublimate ice to solvent vapor without going through a liquid state. During the sublimation drying step, the shelf within the freeze-dryer chamber can be maintained at an adequate temperature for supplying a latent heat of sublimation using the heating and cooling unit.

Solvent vapor released from the contents of the flexible container by sublimation can be captured by a cold trap or other type of capturing unit. In the case of using a cold trap (condenser unit), the cold trap can be cooled to a temperature below the temperature of the contents, and preferably to a temperature that demonstrates a solvent vapor pressure sufficiently lower than the solvent vapor pressure of water at the temperature of the contents (for example, −50 to −60° C.).

In an example, the freeze-drying cycle can include cooling the shelf to less than about −40° C., loading the filled flexible container and its tray onto the shelf, initiating a six or seven day freeze-drying cycle including a four or five day primary drying cycle and a two day secondary drying cycle, ending the secondary drying cycle and break vacuuming using extra dry, high purity carbon dioxide, removing the freeze-dried filled flexible container and placing it in a desiccated storage chamber.

In operation 1612, the freeze-dried blood plasma can be moved to a portion of the flexible container spaced from the membranes and, if present, the membrane frame and the at least one column member and then sealed. Specifically, the flexible container can be removed from the desiccated storage chamber and its freeze-dried blood plasma contents can be moved to a portion of the flexible container including two ports—a reconstitution port and an application port—using a funnel integrated into the flexible container. Prior to making a seal of about 1 inch wide, for example, across an intermediate portion of the flexible container, a downward force can be applied to the membrane frame to cause the at least one column member to collapse. A portion of the seal can be cut through and a first portion of the flexible container, which includes the membranes, the membrane frame and the at least one column member, can be discarded in a biohazard container. A hang lumen can be added to the remaining portion of the formed seal.

In operation 1612, the remaining portion of the formed seal can optionally be cleaned. In an example, the non-discarded second portion of the flexible container can be inverted such that the seal, positioned opposite the reconstitution and application ports, can be immersed into 10% bleach or another cleansing solution. This cleansing can ensure that no blood plasma is on a surface of the seal. After the seal is allowed to soak for about 10 minutes, the second portion of the flexible container can be rinsed with deionized water.

In operation 1614, the second portion of the flexible container can be labeled and packaged. The bar code printed on the identification tag in operation 1604 can be scanned and three labels with associated information can be printed. The three labels can be placed on the second portion of the flexible container, which includes the freeze-dried plasma, an external foil containment pouch and a final packaging. A first label can be placed on the second portion of the flexible container and the original identification tag can be removed. The labeled second portion of the flexible container can then be placed into the external foil containment pouch and packaged. The second portion of the flexible container can be packaged in a military grade ruggedized container with 250 mL of reconstitution liquid, for example, and aseptic tubing for transferring the reconstitution liquid to the flexible container.

Closing Notes:

Existing systems and methods for freeze-drying, repackaging and using freeze-dried contents suffer from concerns of contamination, expense and lack of convenience. Advantageously, the present subject matter provides an economical and efficient system and method for protecting material from contamination through the steps of filling, freeze-drying, packaging, storing and use. The system and method can be designed for blood products such as blood plasma, and can be adoptable to other materials that would benefit from the design and features of the invention.

The above Detailed Description includes references to the accompanying drawings, which form a part of the Detailed Description. The Detailed Description should be read with reference to the drawings. The drawings show, by way of illustration, specific embodiments in which the present system and method can be practiced. These embodiments are also referred to herein as "examples." While certain examples are described with respect a blood plasma biological material, it is to be appreciated that the present disclosure is equally applicable to non-blood related biological materials, as well as non-biological materials.

The Detailed Description is intended to be illustrative and not restrictive. For example, the above-described examples (or one or more features or components thereof) can be used in combination with each other. Other embodiments can be used, such as by one of ordinary skill in the art upon reviewing the above Detailed Description. Also, various features or components have been or can be grouped together to streamline the disclosure. This should not be interpreted as intending that an unclaimed disclosed feature is essential to any claim. Rather, inventive subject matter can lie in less than all features of a particular disclosed embodiment. Thus, the following claim examples are hereby incorporated into the Detailed Description, with each example standing on its own as a separate embodiment:

In Example 1, a system can comprise a flexible container, at least two membranes configured to transmit air or solvent vapor out of the flexible container, and a port allowing for the introduction or withdrawal of a material or substance into or out of the flexible container. The flexible container can be defined in a first direction by a first dimension and in a second direction by a second dimension. The first direction can have an intermediate location separating the flexible container into a first portion, where the membranes reside, and a second portion.

In Example 2, the system of Example 1 can optionally further comprise a membrane frame coupled to at least one of the membranes around its perimeter and the flexible container.

In Example 3, the system of Example 2 can optionally further comprise at least one column member engaged with the membrane frame. The at least one column member can support the membranes and the membrane frame a spaced distance from any material received within the flexible container.

In Example 4, the system of Example 3 can optionally be configured such that the at least one column member includes a plurality of column members configured to change shape or position, relative to the membrane frame, upon application of a downward force to the membrane frame.

In Example 5, the system of Example 4 can optionally be configured such that each of the plurality of column members includes at least one end engaged with the membrane frame and at least one end in contact with a surface of the flexible container.

In Example 6, the system of Example 5 can optionally be configured such that each of the plurality of column members defines a U-shape having its curvature engaged with the membrane frame.

In Example 7, the system of any one or any combination of Examples 3-6 can optionally be configured such that the at least one column member is integral with the membrane frame.

In Example 8, the system of Example 2 can optionally further comprise one or more magnetic or hook members coupled to or integrated with the flexible container, the membranes, or the membrane frame. The magnetic or hook members can interact with an external magnetic member or an external support to maintain the membranes a spaced distance from any material received within the flexible container.

In Example 9, the system of any one or any combination of Examples 1-8 can optionally further comprise a funnel integrated into the flexible container at or near the intermediate location.

In Example 10, the system of any one or any combination of Examples 1-9 can optionally be configured such that the intermediate location separates the flexible container into a first portion that is greater in volume capacity than a second portion.

In Example 11, the system of any one or any combination of Examples 1-10 can optionally be configured such that the membranes include a material selected from a porous polymer, a woven polymeric fabric, a non-woven polymeric fabric, glass fiber or cellulose.

In Example 12, the system of Example 11 can optionally be configured such that the membranes include a porous polymer material in the form of polytetrafluoroethylene.

In Example 13, the system of any one or any combination of Examples 1-12 can optionally be configured such that the port includes a material entry port coupled to the flexible container within the first portion.

In Example 14, the system of any one or any combination of Examples 1-13 can optionally be configured such that the port includes a reconstitution port and an application port. Each port can be coupled to an outer perimeter of the second portion of the flexible container and in fluid communication with an interior of the flexible container.

In Example 15, the system of any one or any combination of Examples 1-14 can optionally further comprise a quantity of material in the form of biological material within the flexible container.

In Example 16, the system of any one or any combination of Examples 1-15 can optionally further comprise a removable cover protecting an upward-facing surface of each membrane.

In Example 17, a method can comprise inserting a material into a flexible container including two or more membranes, freeze-drying the material, moving the freeze-dried material from a first container portion including the membranes to a second container portion spaced from the membranes, and sealing the material within the second container portion. The membranes can be incorporated into a first container side.

In Example 18, the method of Example 17 can optionally further comprise preventing the membranes from contacting the material.

In Example 19, the method of Example 18 can optionally be configured such that preventing the membranes from contacting the material includes maintaining the membranes a spaced distance from a second container side, which is opposite the first container side, by one or more membrane frames and at least one column member.

In Example 20, the method of Example 19 can optionally further comprise applying a force to the one or more membrane frames in a direction of the second container side prior to sealing the material within the second container portion.

In Example 21, the method of Example 20 can optionally be configured such that applying the force to the one or more membrane frames in the direction of the second container side includes causing the at least one column member to collapse relative to the membrane frames.

In Example 22, the method of any one or any combination of Examples 17-21 can optionally further comprise labeling the second container portion in which the material is sealed.

In Example 23, the method of any one or any combination of Examples 17-22 can optionally be configured such that inserting the material into the flexible container includes introducing the material through a material entry port coupled on a first end to a portion of the flexible container including the membranes.

In Example 24, the method of any one or any combination of Examples 17-23 can optionally be configured such that freeze-drying the material in the flexible container includes freeze-drying blood plasma from a single donor or a pooling of donors.

In Example 25, the method of any one or any combination of Examples 17-24 can optionally be configured such that moving the freeze-dried material from the first container portion to the second container portion includes guiding the material into the second container portion using a funnel integrated into the flexible container.

In Example 26, the method of any one or any combination of Examples 17-25 can optionally be configured such that sealing the material within the second container portion includes fluidly coupling a reconstitution port and an application port with the material.

In Example 27, the method of any one or any combination of Examples 17-27 can optionally be configured such that sealing the material within the second container portion includes sealing across a width of the flexible container at a location in which the flexible container has capacity to receive at least 200 mL of a reconstitution liquid.

In Example 28, the method of Example 27 can optionally further comprise cutting through a formed seal and discarding a portion of the flexible container including the membranes.

In Example 29, the system or method of any one or any combination of Examples 1-28 can optionally be configured such that all features, components, operations or other options are available to use or select from.

Certain terms are used throughout this patent document to refer to particular features or components. As one skilled in the art will appreciate, different persons may refer to the same feature or component by different names. This patent document does not intend to distinguish between components or features that differ in name but not in function.

For the following defined terms, certain definitions shall be applied, unless a different definition is given elsewhere in this patent document. The terms "a," "an," and "the" are used to include one or more than one, independent of any other instances or usages of "at least one" or "one or more." The term "or" is used to refer to a nonexclusive or, such that "A or B" includes "A but not B," "B but not A," and "A and B." All numeric values are assumed to be modified by the term "about," whether or not explicitly indicated. The term "about" generally refers to a range of numbers that one of skill in the art would consider equivalent to the recited value (e.g., having the same function or result). In many instances, the term "about" can include numbers that are rounded to the nearest significant figure. The recitation of numerical ranges by endpoints includes all numbers and sub-ranges within that range (e.g., 1 to 4 includes 1, 1.5, 1.75, 2, 2.3, 2.6, 2.9, etc. and 1 to 1.5, 1 to 2, 1 to 3, 2 to 3.5, 2 to 4, 3 to 4, 3 to 4.25, etc.). The term "patient" is intended to include mammals such as for human or veterinary applications.

The scope of the invention should be determined with reference to the appended claims, along with the full scope of equivalents to which such claims are entitled. In the appended claims, the terms "including" and "in which" are used as the plain-English equivalents of the respective terms "comprising" and "wherein." Also, in the following claims, the terms "including" and "comprising" are open-ended; that is, an assembly, kit or method that includes features or components in addition to those listed after such a term in a claim are still deemed to fall within the scope of that claim. Moreover, in the following claims, the terms "first," "second" and "third," etc. are used merely as labels, and are not intended to impose numerical requirements on their objects. It is to be understood that although dependent claims may be set out in single dependent form, the features of these claims can be combined as if the claims were in multiple dependent form.

The Abstract is provided to allow the reader to quickly ascertain the nature of the technical disclosure. It is submitted with the understanding that it will not be used to interpret or limit the scope or meaning of the claims.

What is claimed is:

1. A system, comprising:

a flexible container defined in a first direction by a first dimension and defined in a second direction by a second dimension, the first direction having an intermediate location separating the flexible container into a first portion and a second portion, wherein the intermediate location separates the flexible container such that the first portion is greater in volume capacity than the second portion, and a funnel integrated into the flexible container at or near the intermediate location;

the first portion defined by extending less than a midpoint of the first dimension and extending the entire second dimension, the second portion defined by extending less than the entire second dimension, and the intermediate location defined by extending less than the extent of the second portion in the second dimension;

a quantity of material in the form of freeze-dried biological material within the first portion of the flexible container;

at least two membranes located within the first portion, each membrane configured to transmit air or solvent vapor out of, and resist liquid or contaminant passage into, both the first portion and the second portion of the flexible container; and a port to allow for the introduction or withdrawal of a material or substance into or out of the flexible container.

2. The system of claim 1, further comprising a membrane frame coupled to at least one of the membranes around its perimeter and the flexible container.

3. The system of claim 2, further comprising at least one column member engaged with the membrane frame, the at least one column member configured to support the membranes and the membrane frame a spaced distance from any material received within the flexible container.

4. The system of claim 3, wherein the at least one column member includes a plurality of column members configured to change shape or position, relative to the membrane frame, upon application of a downward force to the membrane frame.

5. The system of claim 4, wherein each of the plurality of column members includes at least one end engaged with the membrane frame and at least one end in contact with a surface of the flexible container.

6. The system of claim 5, wherein each of the plurality of column members defines a U-shape, with the curvature of the U-shape engaged with the membrane frame.

7. The system of claim 3, wherein the at least one column member is integral with the membrane frame.

8. The system of claim 2, further comprising one or more magnetic or hook members coupled to or integrated with the flexible container, the membranes, or the membrane frame and configured to interact with an external magnetic member or an external support to maintain the membranes a spaced distance from any material received within the flexible container.

9. The system of claim 1, wherein the membranes include a material selected from a porous polymer, a woven polymeric fabric, a non-woven polymeric fabric, glass fiber or cellulose.

10. The system of claim 9, wherein the membranes include a porous polymer material in the form of polytetrafluoroethylene.

11. The system of claim 1, wherein the port includes a material entry port coupled to the flexible container within the first portion.

12. The system of claim 1, wherein the port includes a reconstitution port and an application port, each port being coupled to an outer perimeter of the second portion of the flexible container and in fluid communication with an interior of the flexible container.

13. The system of claim 1, further comprising a removable cover protecting an upward-facing surface of each membrane.

* * * * *